United States Patent [19]

Nakai et al.

[11] Patent Number: 4,942,434

[45] Date of Patent: Jul. 17, 1990

[54] FIXED ROLLER FOR AN ELECTROSTATIC IMAGE RECORDER

[75] Inventors: Junji Nakai, Tokyo; Sakae Ishikawa, Kawaguchi, both of Japan

[73] Assignee: Ricoh Company, Ltd., Tokyo, Japan

[21] Appl. No.: 282,258

[22] Filed: Dec. 9, 1988

[30] Foreign Application Priority Data

| | | | |
|---|---|---|---|
| Dec. 11, 1987 | [JP] | Japan | 62-311832 |
| Dec. 16, 1987 | [JP] | Japan | 62-316097 |
| Dec. 24, 1987 | [JP] | Japan | 62-325405 |
| Dec. 28, 1987 | [JP] | Japan | 62-330253 |
| Dec. 28, 1987 | [JP] | Japan | 62-330254 |
| Aug. 26, 1988 | [JP] | Japan | 63-210617 |

[51] Int. Cl.[5] ..... G03G 15/20

[52] U.S. Cl. ..... 355/290; 100/155 R; 100/176; 219/216; 355/295

[58] Field of Search ..... 355/289, 290, 295; 100/168, 176, 93 RP, 155 R; 219/216, 469

[56] References Cited

U.S. PATENT DOCUMENTS

| | | | |
|---|---|---|---|
| 4,348,579 | 9/1982 | Namba | 219/469 X |
| 4,544,435 | 10/1985 | Hawerkamp | 219/469 X |

*Primary Examiner*—R. L. Moses

*Attorney, Agent, or Firm*—Oblon, Spivak, McClelland, Maier & Neustadt

[57] ABSTRACT

A heat roller type fixing device for an electrophotographic copier, printer, facsimile apparatus or similar electrostatic image recorder includes a hollow cylindrical fixing roller having a heating element thereinside and a hollow cylindrical pressing roller held in pressing contact with the fixing roller. A shaft is received in the pressing roller while two annular pressing members are mounted on the shaft through individual bearings so as to urge the cylindrical inner periphery of the pressing roller. The pressing members are each movable on and along the shaft to any predetermined distance as measured from an end of the pressing roller.

13 Claims, 12 Drawing Sheets

START
AUTO MODE ?
YES
NO
REGULAR SIZE ?
YES
NO
HIGH HUMIDITY ? (65%)
YES
NO
TRACING PAPER ?
YES
NO
SMALL SIZE ?
YES
NO
CONTINUOUS COPY ?
YES
NO
A
B
C
D
E
F
G
HIGH HUMIDITY ? (ABOVE 65%)
YES
NO
TRACING PAPER ?
YES
NO
H
I

FIXED ROLLER FOR AN ELECTROSTATIC IMAGE RECORDER

BACKGROUND OF THE INVENTION

1. Field of the Invention

This present invention relates to a heat roller type fixing device for use in an electrophotographic copier, printer, facsimile apparatus or similar electrophotographic image recorder.

2. Discussion of the Background

A heat roller type fixing device is extensively used with an electrostatic image recorder and is constituted by a pair of coactive rollers, i.e. a fixing roller and a pressing roller. The fixing roller is made up of a hollow tubular metal core and a heating element disposed in the metal core. Held in pressing contact with the fixing roller, the pressing roller is comprised of a hollow tubular metal core and a heat-resisting rubber layer provided on the outer periphery of the metal core. In the case that the fixing and pressing rollers have a substantial length for accommodating paper sheets, the width and therefore the size of which is relatively large, the metal core of each roller is usually provided with a thin wall to reduce the weight of the roller, thermal capacity, ect. However, a problem with a fixing device having such long fixing and pressing rollers is that when the pressing roller is pressed against the fixing roller at opposite ends thereof, it is deformed by the pressing force because the span between bearings which are provided at opposite ends of the rollers is long. This effects distribution of nip width defined between the fixing and pressing roller in the lengthwise direction of the rollers, i.e., the nip width is greater at opposite end portions than at the intermediate portion. Consequently, the amount of heat applied to a paper sheet is smaller at the intermediate portion of the rollers than at the opposite end portions, resulting in irregular fixation. Further, the force available for transporting a paper sheet differs from the intermediate portion of the rollers to the opposite end portions, often causing the paper sheet to crease. Although such problems may be solved by increasing the thickness and therefore the rigidity of the walls of the metal cores of the rollers, this kind of implementation brings about another problem in that the mass of each metal core is increased to in turn increase the period of time necessary for the fixing device to reach an operable temperature, i.e. buildup time.

In the light of the above, there has been proposed a fixing device in which the pressing roller is provided with a hollow hand-drum configuration i.e., its diameter is slightly increased at opposite end portions rather than at an intermediate portion, as disclosed in Japanse Laid-Open Patent Publication (Kokai) No. 58-154962 by way of example. A pressing shaft is disposed in the hand-drum type pressing roller while a single bearing is mounted on an intermediate portion of the pressing shaft for supporting the pressing roller. Pressing forces applied to opposite ends of the shaft are imparted to the pressing roller by way of the shaft and bearing, whereby the two rollers are pressed against each other under a substantially uniform force distribution throughout the length of the rollers. This kind of device, however, encounters a problem when the pressing roller has a substantial length and undergoes oscillations due to limited machining accuracy. Specifically, the oscillations cause the contact pressure to increase at the intermediate portion with the result that the nip width becomes greater at the intermediate portion than at opposite end portions. Further, the sheet transport speed is increased at the intermediate portion and not at the opposite end portions, causing a paper sheet to crease. Another drawback with this scheme is that providing the pressing roller with an accurate hand-drum configuration is disproportionately time- and labor-consuming.

SUMMARY OF THE INVENTION

It is therefore an object of the present invention to provide a heat roller type fixing device for an electrostatic image recorder which allows a desired pressure distribution associated with a fixing and a pressing roller to be set up at both an intermediate portion and end portions of the rollers.

It is another object of the present invention to provide a heat roller type fixing device for an electrostatic image recorder in which a pressing roller can be implemented by a simple straight cylinder.

It is another object of the present invention to provide a heat roller type fixing device for an electrostatic image recorder which is operable with a minimum of buildup time.

A heat roller type fixing device for an electrostatic image recorder of the present invention comprises a holllow cylindrical fixing roller accommodating a heat source therein, a hollow cylindrical pressing roller held in pressing contact with the fixing roller, a shaft disposed in the pressing roller, and a plurality of pressing members mounted on the shaft within the pressing roller and urging the cylindrical inner periphery of the pressing roller to impart a pressing force to the pressing roller. The pressing members are each controllably movable to a predetermined position within the pressing roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
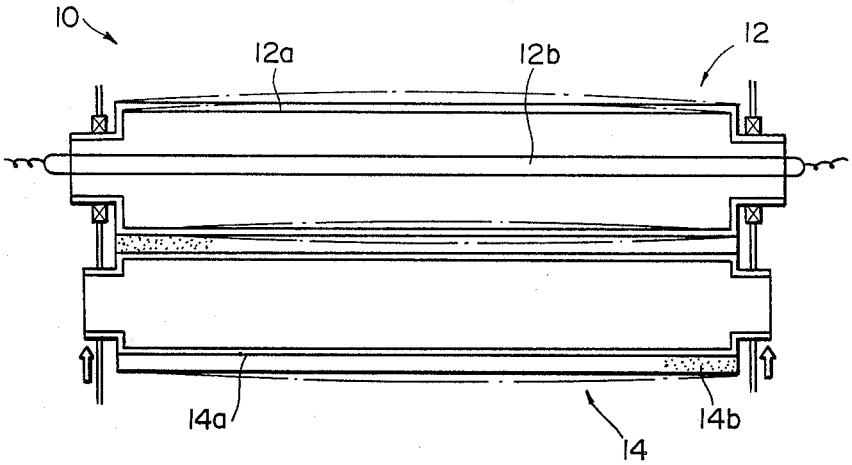
Fig. 1 PRIOR ART
FIG. 1 is a perspective view schematically showing the general construction of a prior art heat roller type fixing device.
Figure 2:
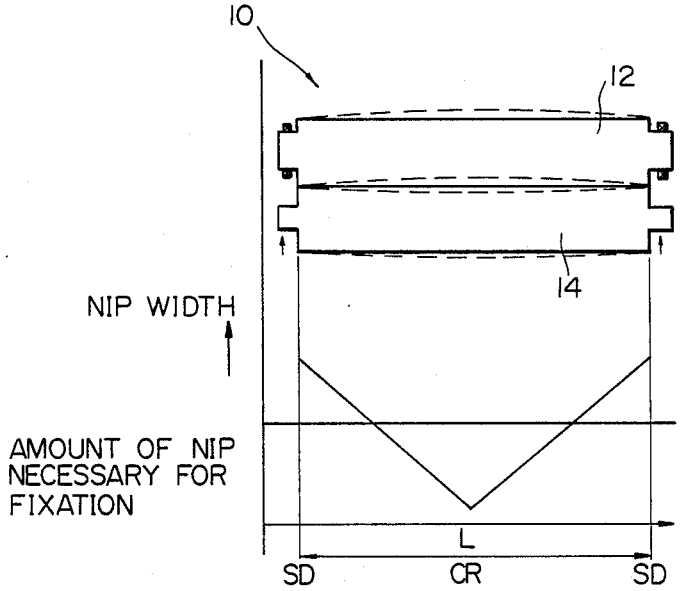
Fig. 2 PRIOR ART
FIG. 2 is a section of the fixing device shown in FIG. 1.

To better understand the present invention , a brief reference will be made to a prior art heat roller type fixing device, shown in FIG. 1. In the figure, the fixing device, generally 10, is made up of a fixing roller 12 and a pressing roller 14. The fixing roller 12 is constituted by a hollow cylindrical metal core 12*a* and a heating element 12*b* disposed in the metal core 12*a*, while the pressing roller 14 is constituted by a hollow cylindrical metal core 14*a* and a heat-resisting rubber layer 14*b* provided on the outer periphery of the metal core 14*a*. When the fixing device 10 is operated with paper sheets having a substantial width, i.e., substantial size, the rollers 12 and 14 have to be increased in length. An increase in the length of the rollers 12 and 14 is of course accompanied by an increase in the weight of the rollers 12 and 14 and, hence, it is necessary to reduce the wall thickness of the metal cores 12*a* and 14*a*. However, when the pressing roller 14 is pressed against the fixing roller 12 at opposite ends thereof, it is deformed by the pressing force because the span between bearings which are provided at opposite ends of the rollers is long. This effects the distribution of nip width defined between the fixing and pressing rollers 12 and 14 in the lengthwise direction of the rollers, i.e., the nip width is greater at opposite end portions than at the intermediate portion. Consequently, the amount of heat applied to a paper sheet is smaller at the intermediate portion of the rollers than at the opposite end portions, resulting in irregular fixation. Further, the force available for transporting a paper sheet differs from the intermediate portion of the rollers to the opposite end portions, often causing the paper sheet to crease. Although such prooblems may be solved by increasing the thickness and therefore the rigidity of the walls of the metal cores 12*a* and 14*a*, this kind of implementation brings about another problem in that the mass of each metal core is increased to in turn increase the buildup time of the fixing device 10.

Figure 3:
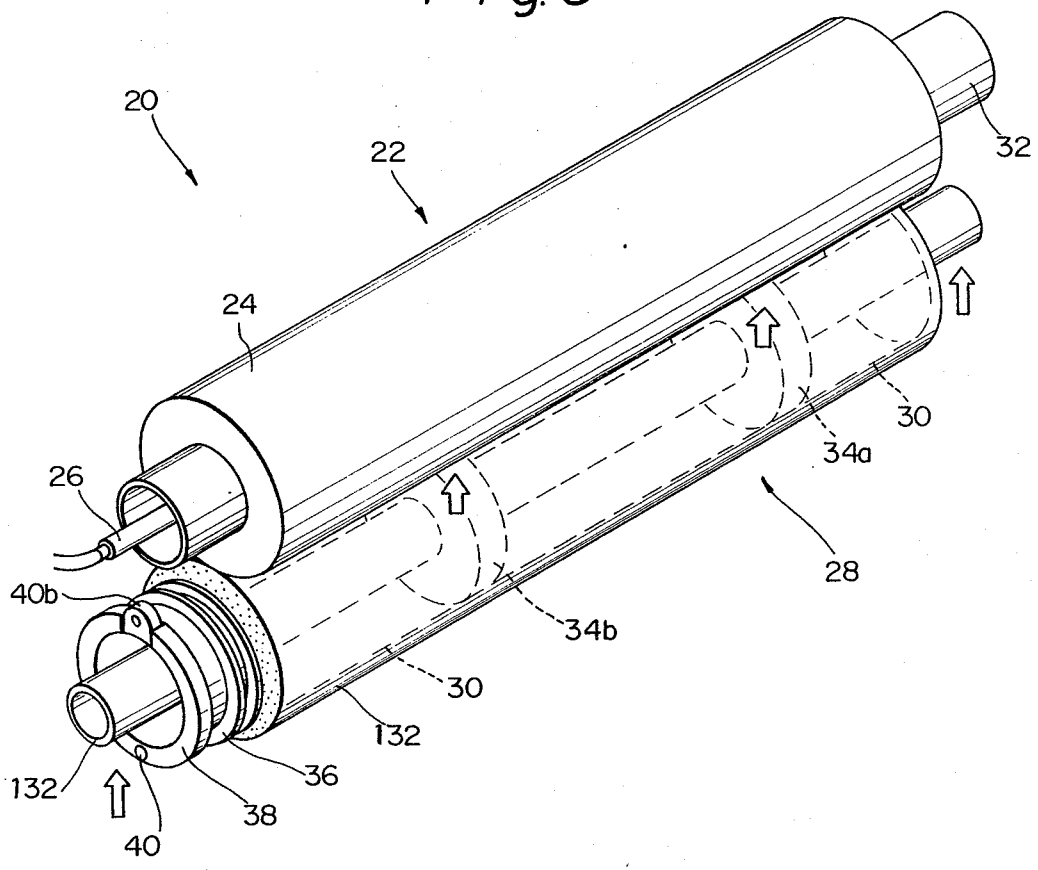
FIG. 3 is a perspective view showing a fixing device embodying the present invention which is made up of a fixing roller and a pressing roller.

Referring to FIG. 3, there is shown a heat roller type fixing device 20 embodying the present invention, particularly a roller section thereof. As shwon, the fixing device 20 includes a fixing roller 22 which is implemented by a hollow core 24 made of aluminum, iron or similar metal. The outer periphery of the metal core 24 is coated with heat-resisting resin such as fluoric resin. A heating element 26 is accommodated in the hollow core 34 and controlled to maintain the surface temperature of the fixing roller 22 within the range of 150° C. to 190° C. A pressing roller 28, like the fixing roller 22, is comprised of a metal core 30 and a heat-resisting rubber layer 132 provided on the metal core 30. The rubber layer may be implemented by silicone rubber by way of example. A shaft 32 extends axially throughout the metal core 30. Two bearings 34*a* and 34*b* which serve as pressing members as will be described are mounted on the shaft 32 and fixed in place with respect to the thrust direction. Pressing forces applied to opposite ends of the shaft 32 are transmitted to the fixing roller 22 via bearings 34*a* and 34*b* and pressing roller 28. A positioning sleeve 38 is inserted in each of opposite ends of the pressing roller 28 through a slide bearing 36.

Figure 4:
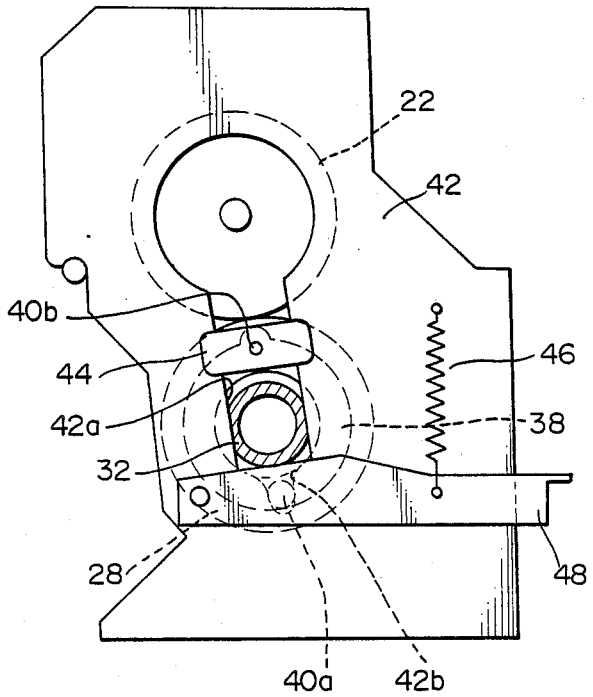
FIG. 4 is a side elevational view of the fixing device shown in FIG. 3.

The positioning sleeve 38 is provided with a projection 40*a*. As shown in FIG. 4, a slot 42*a* is formed through a side wall 42 of the device 20 and contiguous with a slot 42*b* at its lower end. The slot 42*b* extends parallel to a line which interconnects the centers of the rollers 22 and 28. The projection 40*a* of the positioning sleeve 38 is received in the slot 42*b*. The sleeve 38 is further provided with a tap 40*b*. A slide shoe 44 is securely mounted on the sleeve 38 through the tap 40*b* in such a manner as to sandwich the side wall 42 of the device 20. The slide shoe 44 guides the pressing roller 28 along the facing edges of the slot 42*a* of the side wall 42. The side edges of the slot 42*a* also extend parallel to the line which interconnects the centers of the rollers 22 and 28. In this construction, the pressing roller 28 is allowed to move only in the axial direction of the fixing roller 22 which is positioned and supported by the side wall 42 of the device 20. The shaft 32 is constantly biased toward the fixing roller 22 by a lever 48 which is in turn constantly biased by a spring 46. Opposite ends of the shaft 32 are positioned by the facing edges of the slot 42*a* of the side wall 42 in a direction perpendicular to the direction for applying the pressing forces. The pressing forces acting on opposite ends of the shaft 32 are therefore identical with respect to the direction of vector, establishing a uniform pressure distribution along the length of the shaft 32.

Assume that the fixing roller 22 is supported at opposite ends thereof and subjected to an evenly distributed load. Then, the amount of deflection ymax as measured at the intermediate point of the fixing roller 22 is expressed as:

$$ymax = \frac{5wl^4}{384EI} \quad I = \frac{\pi}{64}(D_1^4 - D_2^4)$$

where w, l, E, $D_1$ and $D_2$ are respectively representative of a load per unit length, length of the roller 22, modulus of longitudinal elasticity, outside diameter of the roller 22, and inside diameter of the roller 22. On the other hand, assuming that the buildup time of the machine is t, the following equation is obtained on the basis of a relationship between the thermal capacity of the roller 22 and the capacity of a heat source:

$$t = M\Delta TCp.\ 4.19/W\eta$$

where M is the mass of the roller 22, ΔT is the difference between a cold state of the roller 22 and a predetermined temperature, Cp is the specific heat of the material of the roller 22, W is the wattage of the heating element, and $\eta$ is the efficiency. Thus, it is clear that increasing the wall thickness and therefore the bending regidity (EI) of the roller 22 causes the mass of the roller 22 and therefore the buildup time t to increase although successful in reducing the deflection of the roller 22.

Figure 5A:
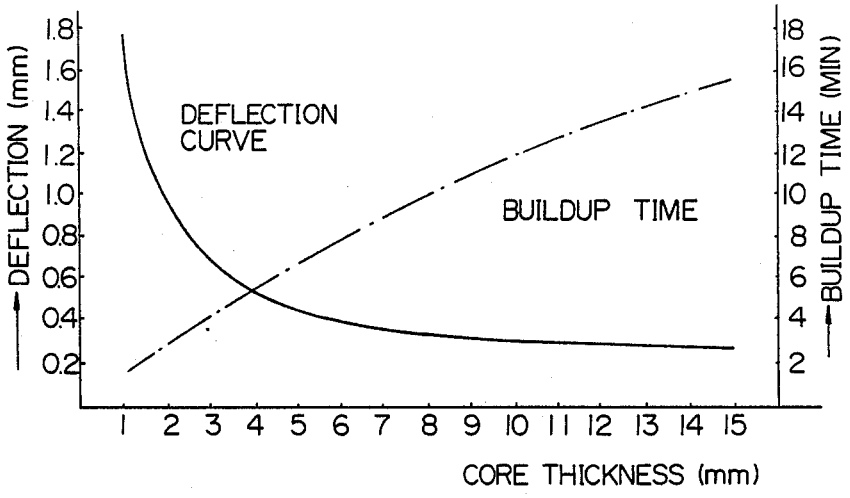
FIG. 5A is a plot representative of a relationship between the amount of deflection of a fixing roller and the buildup time with respect to the wall thickness of a metal core of the fixing roller.
Figure 5B:
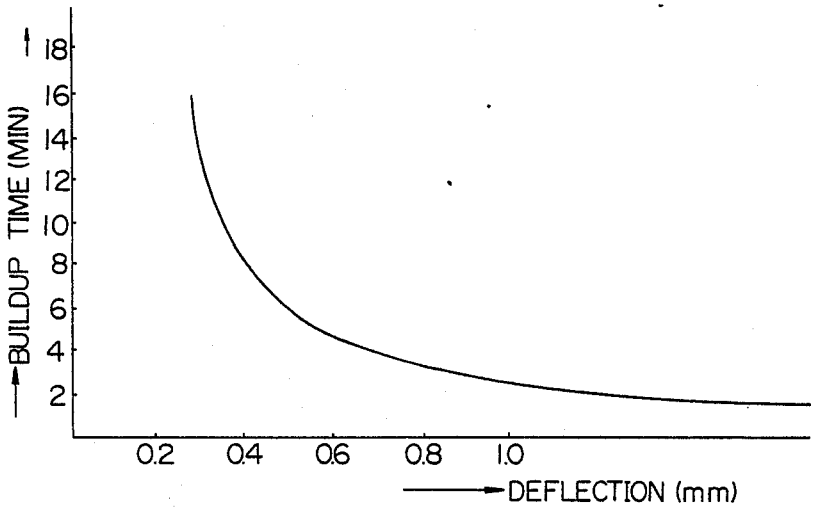
FIG. 5B is a plot representative of a relationship between the amount of deflection and the buildup time.

FIGS. 5A and 5B show the results of actual measurement of such a relationship which were determined with a certain fixing roller. More specifically, FIG. 5A shows a relationship between the thickness of a metal core and the deflection and buildup time, while FIG. 5B shows a relationship between the deflection and the buildup time. Considering the fact that a shorter buildup time leads to a higher performance of a machine, it is not allowable to increase the ridigity of the roller for the purpose of insuring the nip width at the intermediate portion of the roller.

Figure 6:
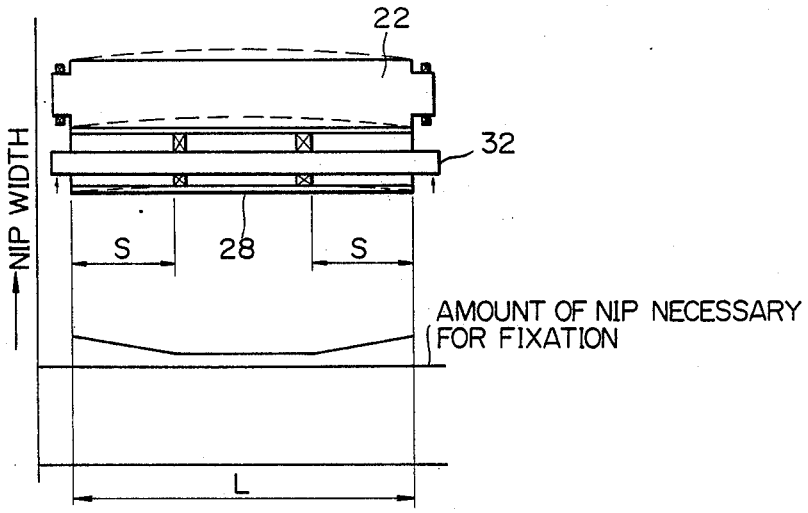
FIG. 6 is a plot showing a nip distribution of a roller section.

In the illustrative embodiment, the shaft 32 is provided in the pressing roller 28 and a pressing force is applied from the roller 28 to the fixing roller 22 via the two bearings or pressing members **34*a* and 34*b* which are mounted on the intermediate portion of the roller 28. Then, as shown in FIG. 6, the pressing roller 28 is not deflected although the fixing roller 22 is deflected, because the pressing force is exerted at the two points as defined by the bearings 34*a* and 34*b*. This guarantees a nip width necessary for fixing even if the wall thickness of the fixing roller 28 is reduced, whereby a desirable nip distribution is set up. Labeled S in FIG. 6** is the distance measured from the end of the rollers.

When the overall length of the rollers 22 and 28 of the fixing device 20 is increased such as for example, 1000 millimeters to accommodate paper sheets of large sizes, the oscillation of the rollers itself is not negligible.

Figure 7A:
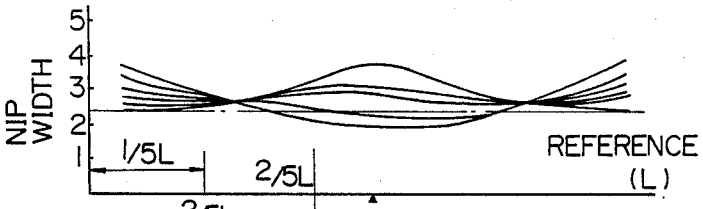
FIGS. 7A to 7D are plots showing nip distribution with respect to various pressing positions which occurs when a pressing roller of FIG. 1 undergoes oscillations.
Figure 7B:
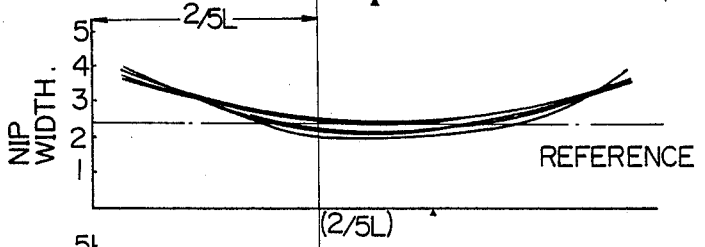
Figure 7C:
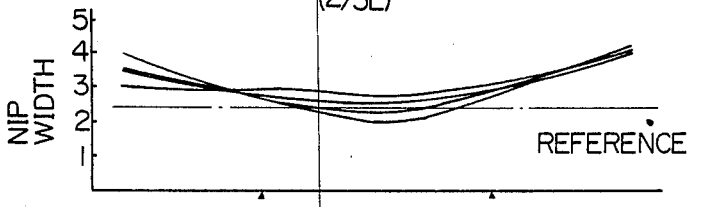
Figure 7D:
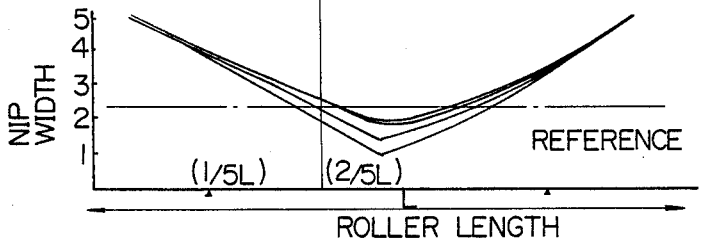

Specifically, when the oscillation of the pressing roller 28 was substantially 0.2 millimeters and the pressing position (indicated by a triangle) was changed, the nip width distribution was varied as shown in FIGS. 7A to 7D for each 1/6 rotation of the pressing roller 28. In this particular embodiment, since the overall length L of the pressing roller 28 is approximately 1000 millimeters, the oscillation of the pressing roller 28 has to be taken into account. More specifically, FIG. 7A shows a case wherein the pressing roller 28 is pressed at its intermediate portion. In this case, the nip distribution is noticeably varied depending upon the angular position of the roller 28 due to the influence of the oscillation of the roller 28. Especially, the nip width is greater at the intermediate portion than at the opposite end portions at some angles and, therefore, the transport speed is higher at the intermediate portion than at the end portions to give rise to the problem of creases. FIGS. 7B to 7D demonstrate nip distributions individually assoicated with the distances S which are 2/5 to 1/5 of the roller length L. With such distances S, the nip distribution does not noticeably change despite the change in the angular position of the roller 28, i.e., the influence of oscillation is reduced. Further, since the nip width is greater at the intermediate portion than at the end portions, the transport speed is higher at the intermediate portion than at the end portions and therefore offers a sheet-smoothing effect. Concerning the nip width distributions shown in FIGS. 7C and 7D, an effect similar to the effect of a fixing roller having a hand-drum shape, i.e., taking longitudinally extending creases out of a paper sheet is achievable. However, should the difference of speed be increased excessively, the trailing edge of some kind of paper would spring up due to the stress causing a non-fixed image to rub against an inlet guide of the fixing device and thereby bringing about various undesirable occurrences such as disturbance to an image and rib-like creasing. It is to be noted that in FIG. 7D the decrease in the nip width in the intermediate portion is not critical in practice.

It will be understood from the above that the two bearings **34*a* and 34*b* may advantageously be located within the range of 1/5.L to 2/5.L each, as measured from the end of the roller 28. The oscillation of the fixing roller 22 has been excluded from the above analysis because the roller 22 can be machined with such a degree of accuracy which renders the oscillation negligible. Oscillation of the fixing roller 22 would also cause the nip distribution to be varied as stated above in relation to the oscillation of the pressing roller 28**.

As described above, by pressing the inner periphery of the pressing roller 28 at two spaced points and thereby pressing the fixing roller 22, it is possible to reduce the wall thickness of the rollers and therefore to reduce the buildup time. Further, by confining the pressing points in the above-discussed range, it is possible to minimize the influence of oscillation of the rollers on the nip distribution.

Figure 8:
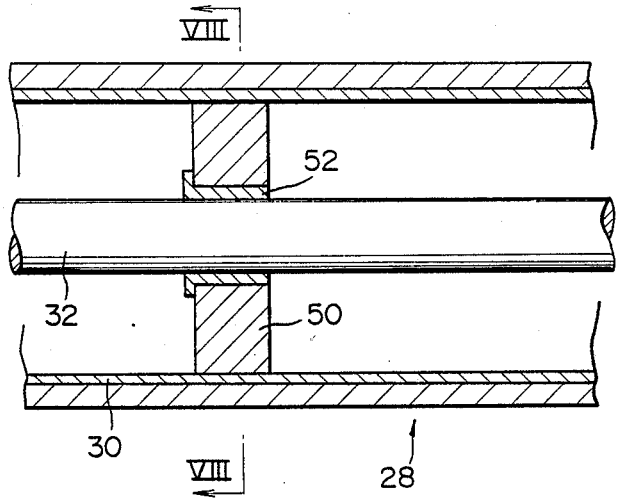
FIG. 8 is a sectional side elevation shwong an alternative specific construction of the pressing roller shown in FIG. 3.
Figure 9:
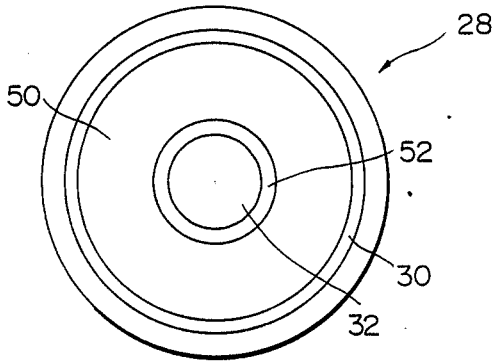
FIG. 9 is a sectional view taken along line VIII—VIII of FIG. 8.

In the illustrative embodiment, the pressing members **34*a* and 34*b* mounted on the shaft 32 are implemented by ball bearings made of metal. Since the heat transferred from the fixing roller 22 to the metal core 30 of the pressing roller 28 is propagated through the ball bearings 34*a* and 34*b* before reaching the shaft 32, the surface temperature of the roller 28 is lower at those portions which make contact with the ball bearings 34*a* and 34*b* than at the other portions by 5° C. or so. This constitutes a cause of irregular fixation. To eliminate this problem, the pressing members adapted to transmit the pressing force from the shaft 32 to the inner periphery of the metal core 30 of the pressing roller 28 may be formed from a heat-insulating material. FIGS. 8 and 9** illustrate an alternative embodiment of the present invention which uses pressing members having such a property.

In FIGS. 8 and 9, a pressing member 50 is comprised of a member which is physically independent of a bearing 52 which is constructed into a slide bearing. The pressing member 50 is made of a heat-insulating material and configured as an annular member which intervenes between the outer periphery of the bearing 52 and the inner periphery of the metal core 30 of the pressing roller 28. The pressing member 50 is not only heat-insulating but also heat- and wear-resisting and may advangeously be made of conducive resin with which carbon particles are mixed to enhance conductivity. This kind of structure prevents heat transferred from the fixing roller 22 to the pressing roller 28 during recording operation from reaching the shaft 32 via the pressing member 50, i.e., it prevents the surface temperature of the roller 28 from being lowered in its portion which makes contact with the pressing member 50 than in the other portions.

Electrostatic charge is deposited on the pressing roller 28. However, since the pressing member 50 is made of a heat-insulating but electrically conductive material, the static electricity is reduced to the ground level so that wrapping of a paper sheet around the pressing roller 28 and the disturbance to an image ascribable to static electricity are eliminated.

Should the pressing members 50 located at two spaced positions on the shaft 32 be solid except for their through openings for coupling with the bearings 52, heat would sequentially accumulate in the closed space delimited by the metal core 30, shaft 32, and the two pressing members 50. This would develop a temperature difference of about 5° C., for example, between the above-mentioned closed space and the spaces outside of the pressing members 50, resulting in an irregular temperature distribution on the surface of the roller 28 and therefore in irregular fixation. To eliminate this problem, the two pressing members 50 may each be formed with a vent for communicating the closed space between the pressing members 50 to the spaces outside of the same.

Figure 10:
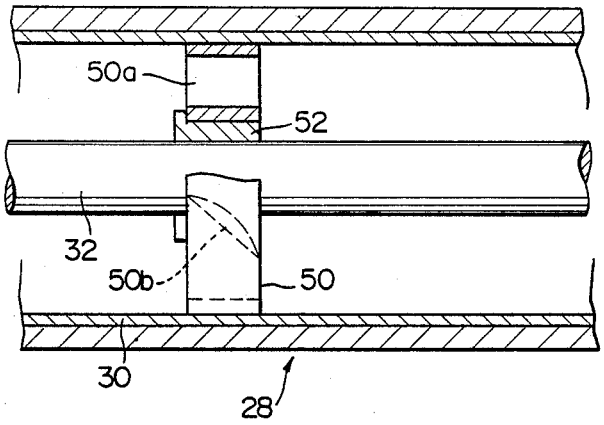
FIG. 10 is a sectional side elevation showing still another specific construction of the pressing roller shown in FIG. 3.
Figure 11:
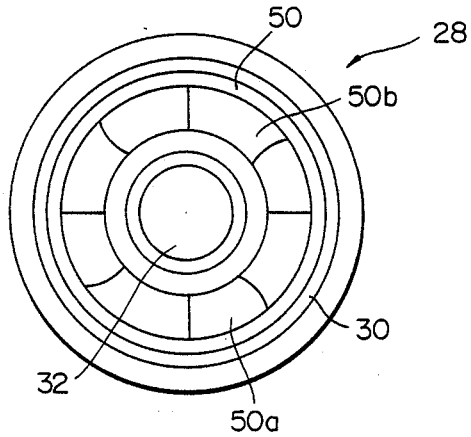
FIG. 11 is a section associated with FIG. 10.

In FIGS. 10 and 11, the vent mentioned above is implemented as an annular opening 50*a* formed through each pressing member 50 and in which stays 50*b* each having a distored wing-like cross-section are disposed. In this configuration, the space between the outer periphery of the shaft 32 and the inner periphery of the metal core 30 and delimited by the pressing members 50 is communicated to the spaced outside of the members 50. In addition, when the pressing roller 28 is rotated during fixing, the distorted stays 50*b* play the role of blades of a fan, i.e., they prevent air from stagnating in the space between the pressing members 50. Consequently, the temperature of the pressing roller 28 is freed from irregularity to insure regular fixation.

In the illustrative embodiment of FIGS. 3 and 4, the pressing roller 28 is positioned in the direction perpendicular to the direction for exerting pressing forces by inserting the sleeves 38 in the opposite ends of the metal core 30 through the associated bearings 36 and mating the projection 40*a* of each sleeve 38 and the guide shoe 44 movably in the slot of the side wall 42 of the device 20.

Figure 12:
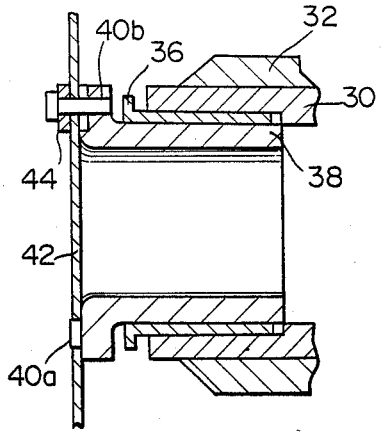
FIGS. 12 and 13 are sections each showing a different structure for mounting the pressing roller on a framwork of an image recorder.

FIG. 12 is a section showing the pressing roller 28 which is mounted on the side wall 42 of the device 20 in the above-mentioned configuration. While a copier or similar machine with the fixing device 20 is in a stand-by condition or in an operative condition, the surface temperature of the fixing roller 22 becomes as high as 150° C. to 190° C. to in turn elevate the surface temperature of the pressing roller 28 to 50° C. to 150° C. At this instant, the metal core 30 oof the roller 28 itself is heated to 150° C. at maximum. Hence, if use were not made of a material whose thermal conductivity is low, the configuration of FIG. 12 would conduct heat from the metal core 30 to the side wall 42 via the bearing 36 and sleeve 38 to thereby lower thermal efficiency and would transfer the heat to other units installed in the machine and which are susceptible to heat. The slide bearings 36, therefore, should preferably be made of a material having low thermal conductivity, e.g. resin.

Figure 13:
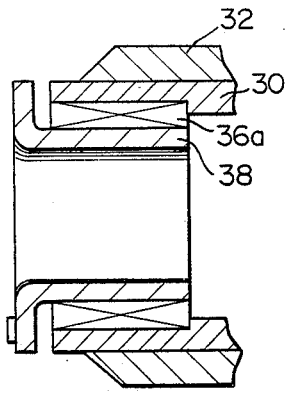

Alternatively, as shown in FIG. 13, each sleeve 38 may be made of heat-insulating resin and a metal bearing 36*a* (needle bearing made of stainless steel) may be disposed between the pressing roller 28 and the sleeve 38. However, in this alternative structure, the thermal expansivity of the resin used for the sleeve 38 is greater than those of the bearing 36 and the metal core 30 of the pressing roller 28. Hence, if the clearance is not sufficient, the sleeve 38 expands during operation to increase the load acting on the bearing 36 to such an extent that the rotation of the pressing roller 28 is impaired or practically disenabled and/or the roller 28 slips on the fixing roller 22. Although the diameter of each sleeve 38 may be reduced in consideration of thermal expansion, it would aggravate the positioning accuracy because the previously discussed broad range of temperature variation has to be accommodated by a substantial clearance.

A solution to this problem may be found by implementing the slide bearing 36 shown in FIG. 12 by a material having low thermal conductivity. More specifically, such a slide bearing 36 is successful in suppressing the temperature elevation of the sleeve 38. Preferably, the slide bearing 36 may be formed from heat-and wear-resisting resin of heat-insulating nature and the sleeve 38 may be made of an iron-based sintered alloy. Then, the metal core 30 of the pressing roller 28, the slide bearing 36 and the sleeve 38 have respectively thermal expansivity of $\beta_1=23.9\times10^{-6}$, $\beta_2=5\times10^{-5}$ and $\beta_3=11.9\times10^{-6}$. Here, $\beta_1$ is equal to or greater than $\beta_3$ and equal to or smaller than $\beta_2$. In such a configuration, as the slide bearing 36 made of resin expands to a certain degree, it is held by the metal core 30 of the pressing roller 28 and thereby prevented from expanding any further. Nevertheless, since the sleeve 38 located at the radially innermost position has the lowest thermal conductivity $\beta_2$ and is little heated, the bearing surfaces of the bearing 36 and sleeve 38 are allowed to rotate smoothly. This allows the clearance to be reduced and thereby accurate positioning to be enhanced.

Figure 14:
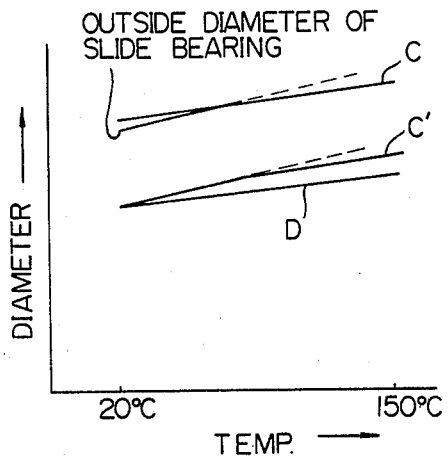
FIGS. 14 and 15 are graphs associated with FIGS. 12 and 13, respectively, demonstrating thermal expansions of bearings and the like ascribable to temperature variation.
Figure 15:
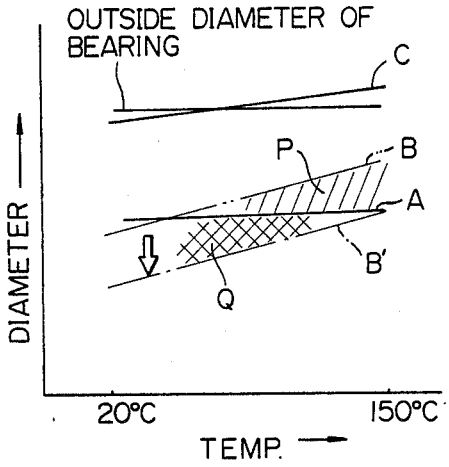
Figure 16:
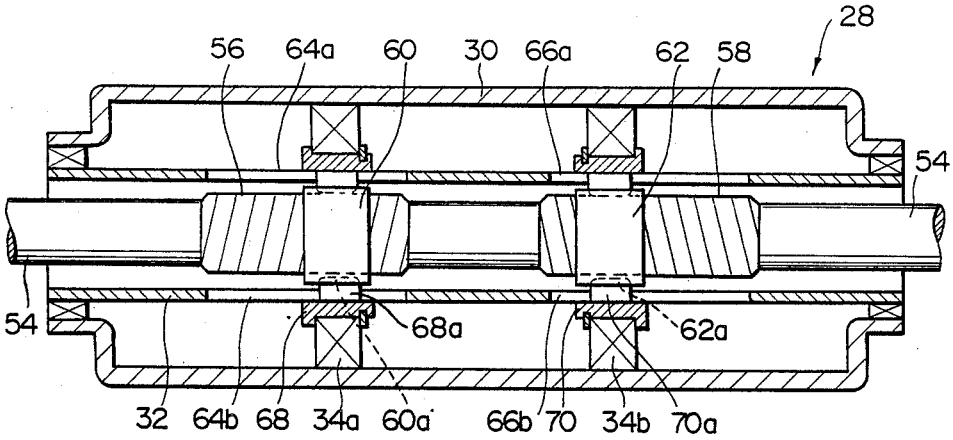
FIG. 16 is a sectional side elevational view showing a structure which allows pressing members in the form of bearings to be positionally adjusted in the axial direction.
Figure 17:
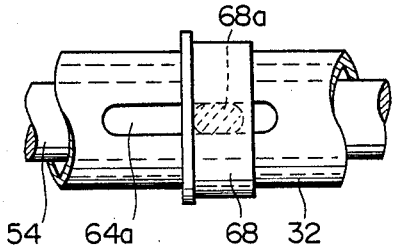
FIG. 17 is a fragmentary top view of the structure shown in FIG. 16.
Figure 18:
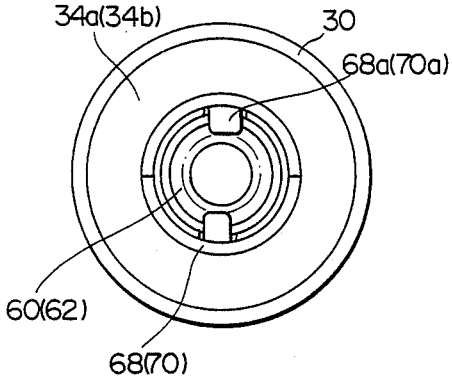
FIG. 18 is a sectional view of the structure shown in FIG. 16.

FIGS. 14 and 15 are graphs demonstrating the conditions of thermal expansion which are associated with the structures of FIGS. 12 and 13, respectively. In FIG. 15, since the thermal expansion of the outside diameter B of the sleeve 38 is greater than that of the inside diameter A of the bearing 36, locking occurs in a region P due to temperature elevation. This cannot be eliminated without reducing the outside diameter of the sleeve 38 such as to B′ beforehand and therefore without developing a play in the bearing 36 in a region Q. In contrast, in FIG. 14, although the outside diameter of the bearing 36 is held by the inside diameter C of the metal core 30 of the pressing roller 28, the thermal expansion of the outside diameter D of the sleeve 38 is so small that the inside diameter C′ of the bearing 36 remains greater than the outside diameter D of the sleeve 38 to eliminate locking even if the temperature is elevated.

Carbon particles are mixed with the resin which constitutes the bearing 36 for enhancing the conductivity of the bearing 36. Although a paper sheet is apt to wrap around the pressing roller 28 due to static electricity which is ascribable to the separation discharge of the rubber layer 132 of the roller 28, the enhanced conductivity of the slide bearing 36 is effective to reduce the fear of jams.

In the fixing device 20 with two bearings or pressing members 34*a* and 34*b*, the pressing points defined by the bearings 34*a* and 34*b* may be changed to achieve the hand-drum effect even with the roller 22 being configured in a simple right cylinder and, yet, the hand-drum effect varies with the positions of the bearings 34*a* and 34*b*, as discussed earlier. Hence, by changing the positions of the bearings 34*a* and 34*b* and therefore increasing and decreasing the hand-drum effect in matching relation to particular conditions of use of the device, there can be eliminated with ease the various drawbacks heretofore encountered with a hand-drum type roller configuration and depending upon the conditions of use, i.e., spring-up of the trailing edge of some kind of paper sheet due to the stresses ascribable to the hand-drum effect, creases of a paper sheet due to the roller 22 which expands in non-sheet regions in a continuous sheet feed mode to excessively enhance the hand-drum effect, etc. Thus, an optimum degree of hand-drum effect can be selected as desired to achieve optimum sheet transport.

Let the positions of the bearings 34*a* and 34*b* shown in FIGS. 7A and 7D be referred to as positions I, II, III and IV, respectively. Then, the positions I to IV are related as I<II<III<IV with respect to the achievable degree of hand-drum effect. All that is is therefore required selecting an adequate position of the bearings 34*a* and 34*b* which offers an optimum hand-drum effect for particular conditions under which the device is operated, e.g. the kind and size of paper sheets, the number of copies to be produced, and the ambient temperature and humidity.

FIGS. 16 to 19 exemplarily show a mechanism for displacing the bearings 34*a* and 34*b*. In the figures, the shaft 32 is provided with a hollow cylindrical configuration while a shaft 54 is coaxially and rotatably received in the shaft 32. Screw-threads 56 and 58 are provided on the shaft 54 symmetrically to each other with respect to the intermediate point of the shaft 54, each screw-thread extending over a certain range and being opposite in direction to the other screw-thread. Feed nuts 60 and 62 are mated with the screw-threads 56 and 58, respectively. The hollow shaft 32 is formed with aligned slots 64*a* and 64*b* and aligned slots 66*a* and 66*b* at two points thereof which are individually associated with the above-mentioned threaded portions of the shaft 54. Bearing holders 68 and 70 are each made up of an upper part and a lower part and mounted on the shaft 32 to be slidable along the axis of the latter. Lugs 68*a* extending toward each other from the inner periphery of the bearing holder 68 are individually received in the aligned slots 64*a* and 64*b* of the shaft 32 and further mated with a recess 60*a* which is formed in the outer periphery of the feed nut 60. Likewise, lugs 70*a* extend from the inner periphery of the bearing holder 70 and associated with the aligned slots 66*a* and 66*b* of the shaft 32 and a recess 62*a* of the feed nut 62 in the same manner as the lugs 68*a*. The ball bearings 34*a* and 34*b* have inner races the radially inner surfaces of which are individually engaged with the outer surfaces of the bearing holders 68 and 70. The radially outer surfaces of outer races of the ball bearings 34*a* and 34*b* are held in contact with the inner periphery of the metal core 30 of the pressing roller 28. In this construction, when the shaft 54 is rotated, the feed nuts 60 and 62 are moved toward or away from the intermediate point of the shaft 54 depending upon the direction of rotation of the shaft 54 and, at the same time, the ball bearings 34*a* and 34*b* are moved toward or away from the intermediate point of the shaft 54 through their associated bearing holders 68 and 70.

Figure 19:
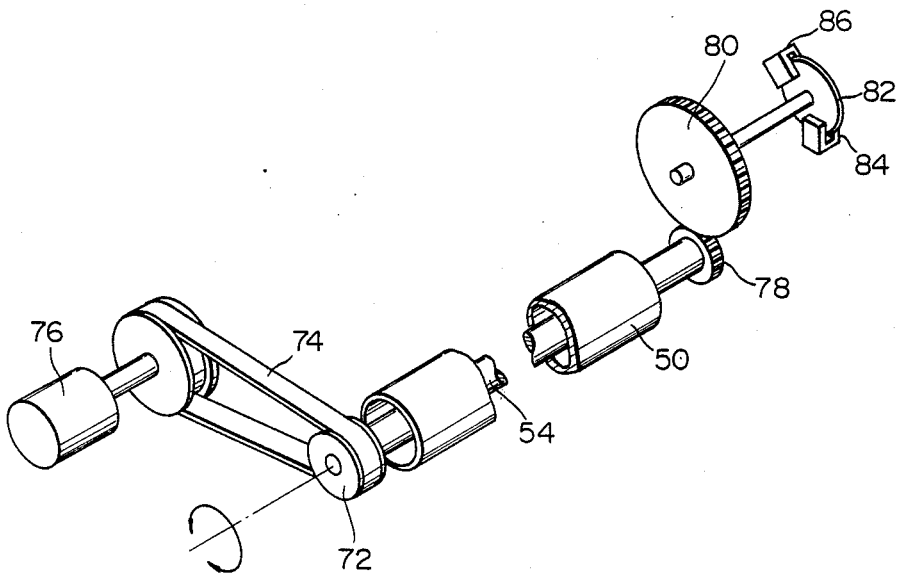
FIG. 19 is a perspective view showing an adjusting mechanism associated with the structure of FIG. 16.

As shown in FIG. 19, a pulley 72 is mounted on one end of the shaft 54 and driven in a rotary motion by a stepping motor 76 through a timing belt 74. A gear 78 is mounted on the other end of the shaft 54. A gear 80 is held in mesh with the gear 78 and provided with a light intercepting plate 82 integrally therewith. A home position sensor 84 and an overrun sensor 86 sense respectively the arrival of the bearings 34*a* and 34*b* at their home position and the overrunning of the same when their optical paths are blocked by the light intercepting plate 82. At the end of copying operations, the bearings 34*a* and 34*b* are returned to their home positions by the stepping motor 76 and then stopped and held at the home positions by the home position sensor 84. Since one full rotation of the intercepting plate 82 defines the stroking distance of the bearings 34*a* and 34*b*, the bearings 34*a* and 34*b* can be returned to the home position even when the power source is turned off midway. As an operator enters a particular position of the bearings 34*a* and 34*b* matching with the various conditions of use by, for example, manipulating buttons which are provided on an operation board, the motor 76 is rotated by pulses the number of which is associated with the number or rotations of the shaft 54 necessary for the bearings 34*a* and 34*b* to move from the home position to the desired position. when an overrun is sensed, the motor 76 is rotated in the reverse direction.

Figures 20, 20A, 20B:
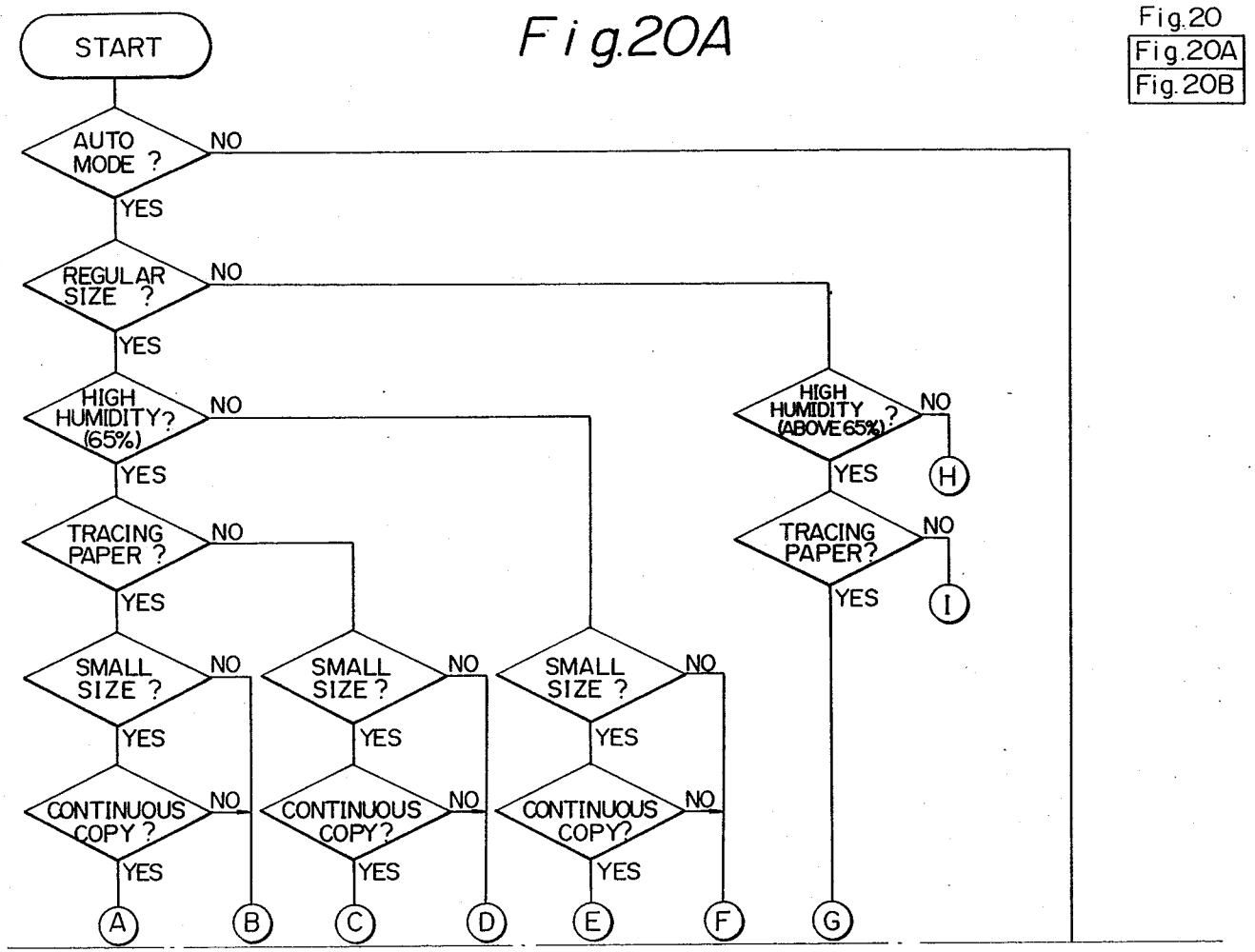
FIGS. 20A and 20B comprise a flowchart demonstrating a sequence of steps for automatically adjusting the positions of the pressing members.
Figure 20B:
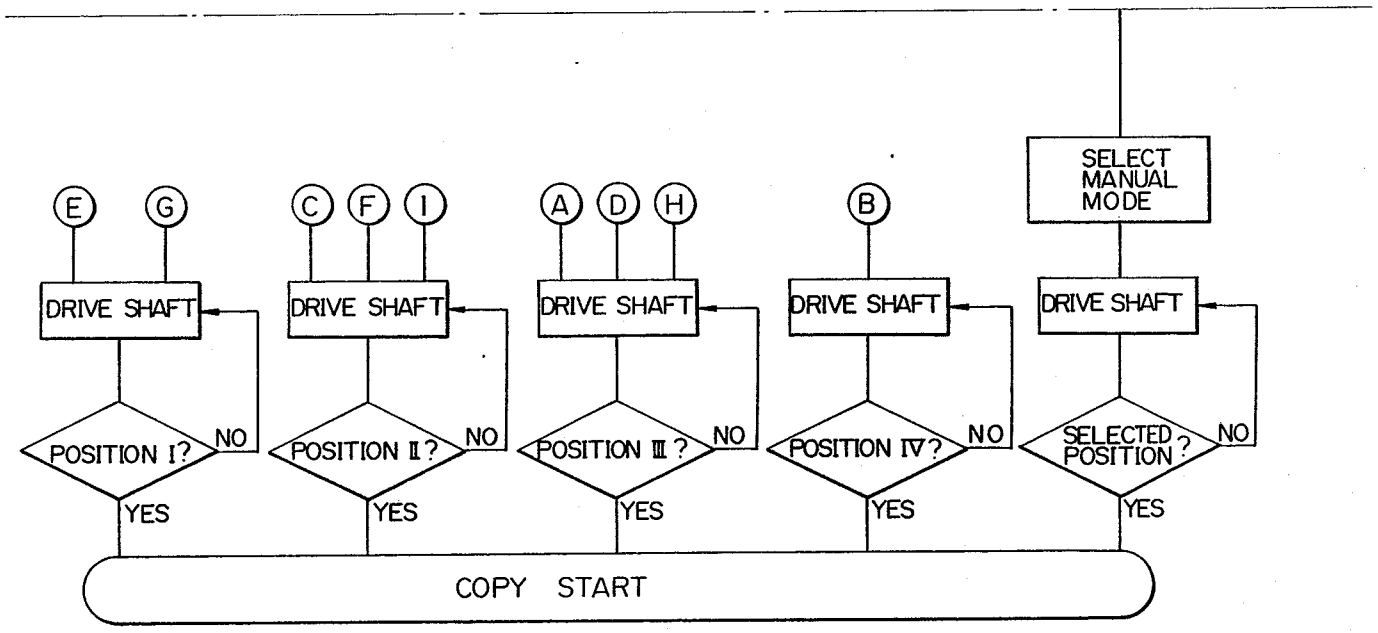

The buttons accessible for selecting a particular position of the bearings 34*a* and 34*b* may be replaced with means for allowing a person to enter various conditions of use of the image recorder or means for automatically detecting them, in which case the bearings 34*a* and 34*b* will be controlled automatically in response to an output of such means. More specifically, when use is made of sensors individually responsive to ambient temperature and ambient humidity and a person enters the size and kind of paper sheets as well as the number of desired copies or such conditions are sensed automatically, the resulting signals are fed to a central processing unit (CPU) to shift the bearings 34*a* and 34*b* to an adequate position. Such a sequence of steps are demonstrated in FIG. 20. Details of the procedure will be clearly understood from the flowchart of FIG. 20 and therefore will not be described to avoid redundancy. The gist of this is that, by determining whether or not the paper sheets are of a regular size, whether or not the ambient humidity is higher than 65%, for example, whether or not the paper sheets are of special material such as tracing paper, and whether or not more than 100 copies are to be produced continuously by using paper sheets of small size, i.e., narrow paper sheets, any of the positions I, II, III and IV is selected according to a predetermined program.

Further, in the illustrative embodiment, a manual mode may be provided for allowing a person to shift the bearings 34*a* and 34*b* as desired by referencing the instructions of an operation manual or based on experience.

By controllably displacing the bearings 34*a* and 34*b* as discussed above, the degree of hand-drum effect heretofore determined by the shape of a hand-drum type fixing roller only is selected in matching relation to the conditions of use of the image recorder. This prevents a paper sheet from creasing or its trailing edge from jumping and thereby promotes positive transport of a paper sheet.

In summary, in accordance with the present invention, a roller of a fixing device having a relatively large size can be reduced in wall thickness to reduce the buildup time of the fixing device. Further, the influence of oscillation of the roller on a nip distribution is reduced.

Various modifications will become possible for those skilled in the art after receiving the teachings of the present disclosure without departing from the scope thereof.

What is claimed is:

1. A heat roller type fixing device for an electrostatic image recorder, comprising:
a hollow cylindrical fixing roller accommodating a heat source in said fixing roller;
a hollow cylindrical pressing roller held in pressing contact with said fixing roller;
a shaft disposed in said pressing roller; and
a plurality of pressing members mounted on said shaft within said pressing roller and urging a cylindrical inner periphery of said pressing roller to impact a pressing force to said pressing roller;
said pressing members being each controllably movable to a predetermined position within said pressing roller wherein said pressing members comprise bearings which are mounted on said shaft.

2. A fixing device as claimed in claim 1, wherein a length L of said pressing roller and a distance S from each end of said pressing roller to a respective one said bearings are related as $1/5\ L \leqq S \leqq 2/5\ L$.

3. A heat roller type fixing device for an electrostatic image recorder, comprising:
a hollow cylindrical fixing roller accommodating a heat source in said fixing roller;
a hollow cylindrical pressing roller held in pressing contact with said fixing roller;
a shaft disposed in said pressing roller; and
a plurality of pressing members mounted on said shaft within said pressing roller and urging a cylindrical inner periphery of said pressing roller to impact a pressing force to said pressing roller;
said pressing members being each controllably movable to a predetermined position within said pressing roller wherein said pressing members comprise annular pressing members each being mounted on said shaft through a bearing.

4. A fixing device as claimed in claim 3, wherein a length L of said pressing roller and a distance S from each end of said pressing roller to a respective one of said pressing members are related as $1/5\ L \leqq S \leqq 2/5\ L$.

5. A heat roller type fixing device for an electrostatic image recorder, comprising:
a hollow cylindrical fixing roller accommodating a heat source in said fixing roller;
a hollow cylindrical pressing roller held in pressing contact with said fixing roller;
a shaft disposed in said pressing roller; and
a plurality of pressing members mounted on said shaft within said pressing roller and urging cylindrical inner periphery of said pressing roller to impact a pressing force to said pressing roller;
said pressing members being each controllably movable to a predetermined position within said pressing roller; and
positioning means mounted on opposite ends of said pressing roller for allowing said pressing roller to move in a pressing direction only.

6. A fixing device as claimed in claim 5, wherein said positioning means comprise bearing members individually inserted in opposite ends of said pressing roller and made of a material having low thermal conductivity, and positioning members each supporting a respective one of said bearing members and movable only in the pressing direction.

7. A fixing device as claimed in claim 6, wherein thermal expansivity $\beta_1$ of a material constituting parts of said pressing roller in which said bearing members are inserted, thermal expansivity $\beta_2$ of said bearing members, and thermal expansivity $\beta_3$ of said positioning members are related as $\beta_3 < \beta_2 \beta_2$.

8. A fixing device as claimed in claim 7, wherein said bearing members are made of resin having conductivity.

9. A heat roller type fixing device for an electrostatic image recorder, comprising:
a hollow cylindrical fixing roller accommodating a heat source in said fixing roller;
a hollow cylindrical pressing roller held in pressing contact with said fixing roller;
a shaft disposed in said pressing roller; and
a plurality of pressing members mounted on said shaft within said pressing roller and urging a cylindrical inner periphery of said pressing roller to impact a pressing force to said pressing roller; and
means mounted on said pressing roller for insulating said pressing roller and said pressing members from said heat source;
said pressing members being each controllably movable to a predetermined position within said pressing roller wherein said pressing members are made of a heat-insulating material having conductivity.

10. A heat roller type fixing device for an electrostatic image recorder, comprising:
a hollow cylindrical fixing roller accommodating a heat source in said fixing roller;
a hollow cylindrical pressing roller held in pressing contact with said fixing roller;
a shaft disposed in said pressing roller; and
a plurality of pressing members mounted on said shaft within said pressing roller and urging a cylindrical inner periphery of said pressing roller to impact a pressing force to said pressing roller;
said pressing members being each controllably movable to a predetermined position within said pressing roller; and
displacing means for moving said pressing members along said shaft.

11. A fixing device as claimed in claim 10, and which comprises sensor means responsive to conditions under which said image recorder is to be operated and control means responsive to outputs of said sensor means for controlling positions of said pressing members.

12. A fixing device as claimed in claim 11, wherein said conditions include ambient temperature, ambient humidity, a size of paper sheets, and a number of copies to be produced continuously.

13. A heat roller type fixing device for an electrostatic image recorder, comprising:
a cylindrical fixing roller accommodating a heat source in said fixing roller;
a cylindrical pressing roller held in pressing contact with said fixing roller;
a shaft disposed in said pressing roller;
a plurality of pressing members mounted on said shaft within said pressing roller and urging a cylindrical inner periphery of said pressing roller to impact a pressing force to said pressing roller; and
means mounted on said pressing roller for insulating said pressing roller and said pressing members from said heat source;
said pressing members being each controllably movable to a predetermined position within said pressing roller.

* * * * *

UNITED STATES PATENT AND TRADEMARK OFFICE

CERTIFICATE OF CORRECTION

PATENT NO. : 4,942,434

DATED : July 17, 1990

INVENTOR(S) : Junji Nakai, et al

It is certified that error appears in the above-identified patent and that said Letters Patent is hereby corrected as shown below:

On the title page and in the title, delete "FIXED" and insert --FIXING--.

Signed and Sealed this

Twenty-seventh Day of August, 1991

*Attest:*

*Attesting Officer*

HARRY F. MANBECK, JR.

*Commissioner of Patents and Trademarks*